US009090091B2

(12) United States Patent
Till

(10) Patent No.: US 9,090,091 B2
(45) Date of Patent: Jul. 28, 2015

(54) EQUIPMENT FOR PRINTING ON CONTAINERS

(75) Inventor: Heinz Till, Hofheim am Taunus (DE)

(73) Assignee: KHS GmbH, Dortmund (DE)

( * ) Notice: Subject to any disclaimer, the term of this patent is extended or adjusted under 35 U.S.C. 154(b) by 455 days.

(21) Appl. No.: 13/384,695

(22) PCT Filed: Jul. 8, 2010

(86) PCT No.: PCT/EP2010/004162

§ 371 (c)(1),
(2), (4) Date: Apr. 26, 2012

(87) PCT Pub. No.: WO2011/009536

PCT Pub. Date: Jan. 27, 2011

(65) Prior Publication Data

US 2012/0199021 A1 Aug. 9, 2012

(30) Foreign Application Priority Data

Jul. 18, 2009 (DE) ..... 10 2009 033 810

(51) Int. Cl.

| | |
|---|---|
| ***B41F 17/00*** | (2006.01) |
| ***B41J 3/407*** | (2006.01) |
| ***B41F 17/18*** | (2006.01) |
| ***B41J 2/01*** | (2006.01) |
| ***B41F 17/28*** | (2006.01) |
| ***B41J 3/54*** | (2006.01) |
| *B41J 11/00* | (2006.01) |

(52) U.S. Cl.

CPC ..... *B41J 3/4073* (2013.01); *B41F 17/18* (2013.01); *B41F 17/28* (2013.01); *B41J 2/01* (2013.01); *B41J 3/543* (2013.01); *B41J 11/002* (2013.01)

(58) Field of Classification Search

CPC ..... B41J 3/4073; B41J 3/407; B41J 2/01; B41J 11/002; B41F 15/30; B41F 17/006; B41F 17/18; B41F 17/14; B41F 17/16; B41F 17/20; B41F 17/28; B41F 17/30; B41P 2217/00; B41P 2217/61; B41P 2217/62

USPC ..... 101/35, 36, 38.1, 39, 40, 40.1, 101/484–486; 347/4

See application file for complete search history.

(56) References Cited

U.S. PATENT DOCUMENTS

| | | | | |
|---|---|---|---|---|
| 5,121,827 | A * | 6/1992 | Ribordy | 198/377.06 |
| 6,295,737 | B2 * | 10/2001 | Patton et al. | 33/18.1 |
| 6,769,357 | B1 | 8/2004 | Finan | |
| 7,210,408 | B2 | 5/2007 | Uptergrove | |
| 8,256,854 | B2 * | 9/2012 | Till | 347/2 |

(Continued)

FOREIGN PATENT DOCUMENTS

| | | |
|---|---|---|
| DE | 4009642 | 8/1991 |
| DE | 29818055 | 4/1999 |

(Continued)

*Primary Examiner* — Blake A Tankersley
*Assistant Examiner* — Marissa Ferguson Samreth
(74) *Attorney, Agent, or Firm* — Occhiuti & Rohlicek LLP

(57) ABSTRACT

The invention relates to equipment for printing on containers (B), such as bottles, having a printed design (D) on at least one printing machine having at least one print head (1), and is characterized in that the at least one print head (1) is automatically adjustable by means of an electrical controller. An adjustment value from the controller moves the print head (1) according to spatial co-ordinates and/or an angular position into a position that is determined or calculated by means of a measuring device having e.g. sensors from the surface contour and the position relative to the print head (1) of the container (B) to be printed upon.

16 Claims, 4 Drawing Sheets

(56) References Cited

U.S. PATENT DOCUMENTS

| | | | | |
|---|---|---|---|---|
| 2005/0045263 | A1* | 3/2005 | Heuft et al. | 156/64 |
| 2006/0144261 | A1 | 7/2006 | Uptergrove | |
| 2009/0294069 | A1* | 12/2009 | Kramer et al. | 156/362 |
| 2010/0192517 | A1* | 8/2010 | Schach | 53/411 |
| 2010/0257819 | A1 | 10/2010 | Schach | |

FOREIGN PATENT DOCUMENTS

| | | | | |
|---|---|---|---|---|
| DE | 10115543 | | 10/2002 | |
| DE | 102006001223 | | 7/2007 | |
| DE | 102006019441 | | 10/2007 | |
| DE | 102007036752 | | 2/2009 | |
| DE | 102007050490 | | 4/2009 | |
| EP | 0209896 | | 1/1987 | |
| EP | 0931649 | | 7/1999 | |
| EP | 0729846 | * | 1/2000 | B41J 11/46 |
| WO | 99/08935 | | 2/1999 | |
| WO | 2004/016438 | | 2/2004 | |
| WO | 2009/018892 | * | 2/2009 | B41J 3/407 |
| WO | 2011/009536 | | 1/2011 | |

* cited by examiner

EQUIPMENT FOR PRINTING ON CONTAINERS

RELATED APPLICATIONS

This application is the national stage application of International Application No. PCT/EP2010/004162, filed Jul. 8, 2010, which claims the benefit of the Jul. 18, 2009 priority of German application no. 10 2009 033 810.1. The contents of the foregoing applications are incorporated herein in their entirety.

FIELD OF INVENTION

The invention relates to container processing, and in particular, to printing an image on a container.

BACKGROUND

It is known to label a container, such as a bottle or a package, with a label.

Also known are printing systems that apply individualized marks or other information on a container with ink jet printers in ways that are not permitted by label printing. Such printing systems work in monochrome and are restricted to a few printing dots or lines.

Also known are wide print heads that can print widths of up to 174 mm per print head using print heads of different manufacturers. These print heads also work in monochrome.

To print in multiple colors, it is known to use several of these monochrome print heads, one for each color. These monochrome print heads are arranged one after the other and are offset to achieve an even pitch between individual printing dots. On a machine having a plurality of print heads arranged one after the other in a fixed manner, the pitch can be adjusted. In these machines, containers to be printed upon move past the print heads with constant speed. The number of containers that can be printed on per unit time by such a machine therefore depends on the printing speed of a print head.

Machines along the lines of the foregoing are practical for printing on absorbent packaging materials. However, if one wishes to print on a non-absorbent material, such as metal, glass or plastic, the ink typically has to cure between colors. Known ways to cure ink involve using heat to dry the ink, or using UV or electron beams to cause cross-linking in the ink. The need to cure the ink of one color before printing the next color means that the monochrome print heads can no longer be right next to each other. This is because curing stations must now be provided. This increases the length of such machines. If one wishes to increase the number of containers printed upon per unit time, either a plurality of printing systems have to be connected in parallel, or a different arrangement has to be selected.

The prior art also suggests arranging holders on a carousel, placing a container in each holder, and guiding the container along a circular path past print heads. A disadvantage of this is that it becomes difficult to cure the individual inks because one cannot insert an intermediate drying or cross-linking station.

Another known device features individual carousels arranged one after the other in series. Curing takes place during the transfer between adjacent carousels. These embodiments feature holding devices to clamp the containers in a centered position on corresponding independent transport units. A belt moves the holding devices, and hence the containers, one after the other through the series of carousels. Each holding device has a rotary mounting so that the entire surface of the container can be exposed to the print head. Also known is having a marking on each holding device to mark the zero-degree angle.

The requirements of centering and maintaining the accuracy of the guide for achieving a high-quality print image, however, are high. Doing so is a complex undertaking impeded by several physical constraints. For example, during start-up and braking, different tensile forces act on the belt. There can also be temperature fluctuations that cause expansion or contraction. Both of these effects can lead to tolerances being exceeded to the point where they cannot be compensated for.

To make matters worse, the container can sometimes be quite heavy. For example, when the container is a bottle, the printing normally takes place after the bottle has been filled. Added to this weight is the mass of the holding device itself. Moving heavy objects with great precision is often difficult.

The precision of the centering requirement is quite high. For example, when printing at the usual 600 dpi, the printing dots are 0.042 mm apart from one another. It is very hard to reliably align a holding device that is holding a rather heavy bottle filled with liquid to within 1/100 mm.

Additionally, the wear and tear on a commercial printing machine is very high. A printing machine used in the beverage industry can typically process 36,000 bottles/hour. This means that more than 200,000,000 annually pass through such a machine. Because of this, the wear on the machine is huge, and substantially influences the printing quality.

SUMMARY

An object of the invention is to reliably achieve high printing quality and high printing output on a commercial printing machine that prints on containers.

In one embodiment, this object is achieved by having at least one print head that is automatically adjustable by an electric control device. An adjusting value from the control device moves the print head into a position according to location coordinates and/or angular position. These are determined or calculated from the surface contour and the position of the bottle to be printed upon relative to the print head by means of an image-capturing device that comprises, for example, sensors.

In another embodiment, at least one further printing machine of the type described above is arranged downstream of the first printing machine for printing with the same or different color, so that, with the same advantage, print images having different colors can be created.

In such an embodiment, the two printing machines can operate individually and independently of each other or be interlinked in a controlled way to apply the multi-colored print image to the container.

Another embodiment improves the accuracy of the print image by having a printing machine print a mark on a container. This mark helps position and/or align the print head at a further printing machine.

The mark can be provided on the print image, for example as an irregular polygon. In some cases, the mark is an isosceles triangle. In yet other cases, part of the print image itself serves as a mark.

The mark can be captured via a camera or an image-processing device comprising, for example, sensors. The camera or image-processing device emits a corresponding output signal to the print head for positioning the print head correctly.

In some embodiments, the data gained from the mark is used to assist in adjusting the print head of a printing machine connected downstream so that it can print with the same or a further color on the print image printed by a preceding printing machine. This can be done using stepping motors or servomotors to adjust the height of the print head, its spacing from the container spacing, and/or its inclination.

In another embodiment, the container to be printed upon is introduced into a station of a rotational treatment machine, such as a carousel, by an inlet star from, for example, a linear conveying device. The container is then centered in a clamping device, and set into rotary motion for printing.

With the help of data gained from the mark, the rotational angle of the container at which printing commences can be determined.

In some embodiments, it is advantageous for the container to be rotated in a printing station while its surface is being printed upon while the entire carousel is rotating.

After having been printed upon, a discharge star can transport the container out of the carousel. If necessary, the container is passed through a UV-tunnel to cure the applied ink before introducing it into a further printing machine, if applicable of the same design, for further printing in the same manner.

Accordingly, the invention can also be carried out on linear machines.

In one aspect, the invention features an apparatus for printing a design on a container. Such an apparatus includes a first rotational treatment machine, a second rotational treatment machine that follows the first rotational treatment machine, and a control device that operably interlinks the first rotational treatment machine and the second rotational treatment machine. Each of the first and second rotational treatment machines comprises a plurality of printing stations. Each printing station has a print head that has an adjustable position and orientation relative to a container, and a measuring device configured to determine the position and orientation of the print head relative to the container. The measuring device has sensors that are arranged such that a distance between the print head and the container is continuously measurable. The measuring device is configured to receive, from the sensors, information representative of the position and orientation of the print head relative to the container and to provide the information to the control device. The position and orientation of the print head relative to the container is adjustable by the controller based at least in part on the information provided by the measuring device.

In some embodiments, the first rotational treatment machine is configured to print a marker on the container, and the second rotational treatment machine is configured to use the marker as a basis for either positioning or aligning a print head of the second rotational treatment machine.

Some embodiments further include an infeed starwheel, a carousel, a linear conveying device, a clamping device, and a printing station. The printing station is disposed on the carousel. The infeed starwheel is configured to receive a container from the linear conveying device and to introduce the container into the printing station of the carousel. The clamping device is configured to center the received container and to place the container into rotation.

In some of these embodiments, the printing station is configured to rotate the container during revolution of the carousel by at least one complete rotation while the container is being printed upon.

Among these embodiments are those that have an outfeed starwheel, and a UV tunnel. In these embodiments, the outfeed starwheel is disposed to transport a container to the UV tunnel, and the UV tunnel is configured to cure ink that has been applied to the container.

Also among these embodiments are those in which the UV tunnel is disposed between the first and second rotational treatment machines such that a container that has been printed on by the first rotational treatment machine passes through the UV tunnel on its way to the second rotational treatment machine. As a result, ink placed on the container by the first rotational treatment machine is cured by the time the container arrives at the second rotational treatment machine.

In some embodiments, the first rotational treatment machine is configured to print a marker on the container, and the second rotational treatment machine comprises a camera for capturing an image of the marker and emitting an alignment signal for positioning the print head of the second rotational treatment machine.

BRIEF DESCRIPTION OF THE DRAWINGS

Further objectives, features, advantages and application possibilities of the invention are obtained from the following description of exemplary embodiments by means of the drawings, in which.

DETAILED DESCRIPTION

Figure 3A:
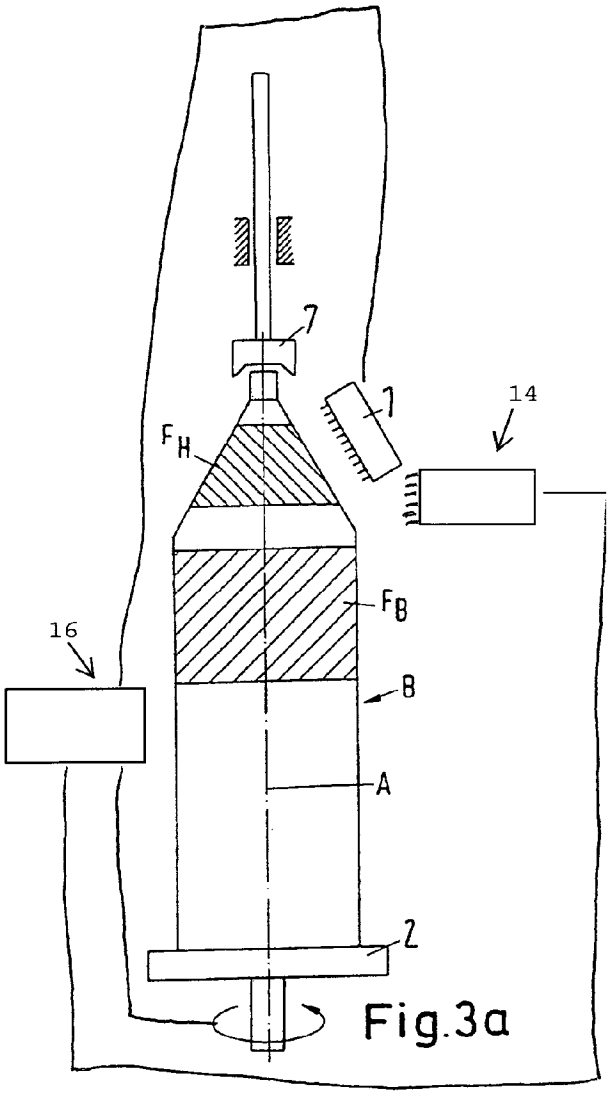
FIGS. 3*a* and 3*b* show a centering clamping device for two containers of different size in a printing station.
Figure 3B:
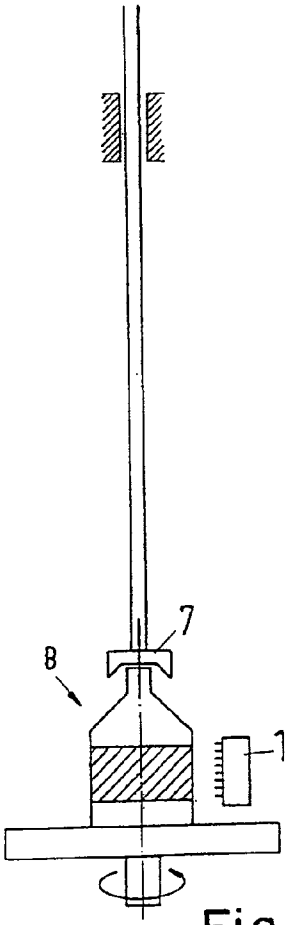

FIG. 1 shows locations at which a bottle-shaped container B can be printed upon by a print head 1. These locations include the belly FB and the neck FH. During printing, the container B is placed on a turntable 2, as shown in FIGS. 3*a* and 3*b*.

The turntable 2 sets the container B into rotary motion during the printing process. The print image D is applied to the surface of the container B in the region of the belly FB and/or the neck FH. Location coordinates and angles that specify the position and orientation of the print head 1 are automatically determined through the shape and position of the container B as sensed with the help of a camera or an image-processing device 14. The camera or image-processing device emits corresponding alignment signals to the print head 1 via a control device 16.

Certain adjustments can be made to the position and orientation of the print head 1 as a function of the container shape and the alignment of the container.

In particular, since the print image surface F of the container B can be at different heights relative to the turntable 2, the height of the print head 1 is adjustable by adjusting its position along a z-axis, which is an axis that extends in a direction perpendicular to the surface of the turntable 2. The distance of the print head 1 from the container axis A is likewise adjustable by adjusting the position of the print head 1 along an x-axis, which is perpendicular to the z-axis. The angular position of the print head 1 is also adjustable.

Figure 1A:
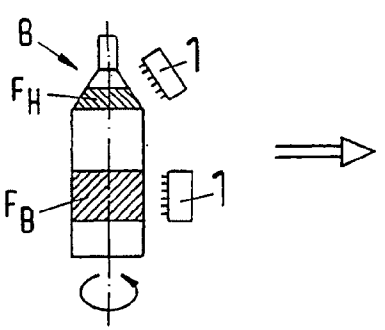
FIGS. 1*a* to 1*d* show positions of a print head of a printing machine of a plant according to the invention relative to a bottle.
Figure 1B:
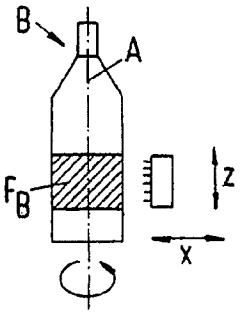
Figure 1C:
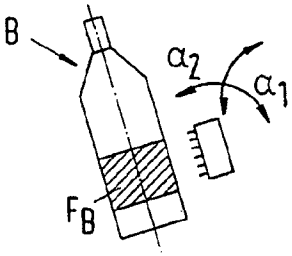
Figure 1D:
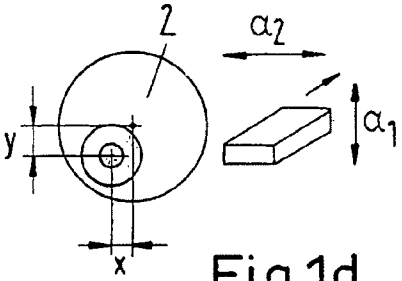

In the case of a bottle, it is quite possible that the center points of the bottle's bottom and the bottle's mouth will not be in the same position on a subsequent printing machine as they were in a preceding printing machine. Additionally, the bottle may not be perpendicular at the subsequent printing machine. Alignment in the angles α1 and α2 is provided also for that reason, as shown in FIG. 1*d*.

Figure 2:
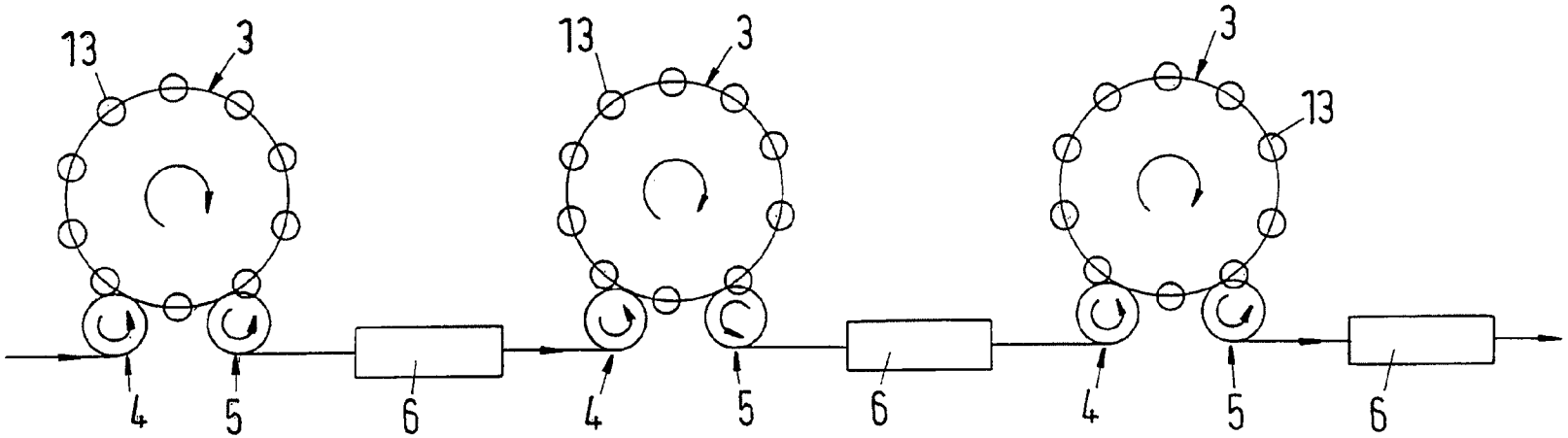
FIG. 2 shows an arrangement of three printing machines one after the other in a plant according to the invention.

FIG. 2 illustrates a plant for printing images on containers B. The illustrated plant has three rotational treatment machines. In the illustrated embodiment, the rotational treatment machines are carousels 3 connected one after the other. Each carousel 3 has a plurality of printing stations 13. Unprinted containers B are initially brought into the first carousel 3 from a linear conveying section by an inlet star 4. Once at the first carousel 3, each unprinted container is centered and clamped on a turntable 2 at one of the stations 13, as shown in FIGS. 3*a* and 3*b*.

During printing, each container B rotates about its axis A. In particular, the rotation of each container B is synchronized with the rotation of the carousel 3 so that one revolution of a container corresponds to one revolution of the carousel 3. A discharge star 5 then transports the containers B, which have now been printed on, into the conveying section. The ink is then dried or cured. In some embodiments, this takes place in a UV-tunnel 6. After the ink has been dried or cured, the container B reaches a second printing machine. This second printing machine comprises a carousel 3 for applying the next color.

For example, a container B, from the fourth station 13 of the first printing machine can be placed at the fifth station 13 of the second or the seventh station 13 of a following third printing machine. Since a printing process, including container alignment, takes approximately two seconds, carousels with ten containers per second process 36,000 containers per hour therefore have approximately eight to nine stations 13 including inlet/outlet. Aligning the tolerances of six printing machines in the case of a six-color print and nine stations each, i.e. 72 stations in total, such that all containers receive the print image D accurately to 1/100 mm is impossible. For this reason it is important that the distance of the print head 1 from the turntable middle be adjustable along the x-axis.

In some cases, the position of the print image changes. This can arise, for example, if the container changes. Or it can arise because the position of the printed image on a container changes. In either case, the print head 1 is moved. This movement involves a gross adjustment and a fine adjustment.

FIGS. 3*a* and 3*b* illustrate the clamping of different containers B between a turntable 2 and an adjustable counterholder 7. As is apparent from these figures, changing to a different container requires a gross adjustment of the printhead position, for example by adjustment along the x-axis and the z-axis. Changing to a different container can also require gross adjustment of the orientation of the print head 1 by adjusting the angles α1 and α2. The gross adjustment shown in FIGS. 3*a* and 3*b* is followed by a fine adjustment during the printing process in order to offset undesirable overshooting of tolerances.

As shown in FIGS. 3*a* and 3*b*, the gross adjustment that arises when switching between different containers involves a large range of adjustment to be able to accommodate both short and tall bottles and wide and skinny bottles. The fine adjustment, which requires adjustment on the order of only a few tenths of a millimeter, takes place during the actual printing.

Figure 4B:
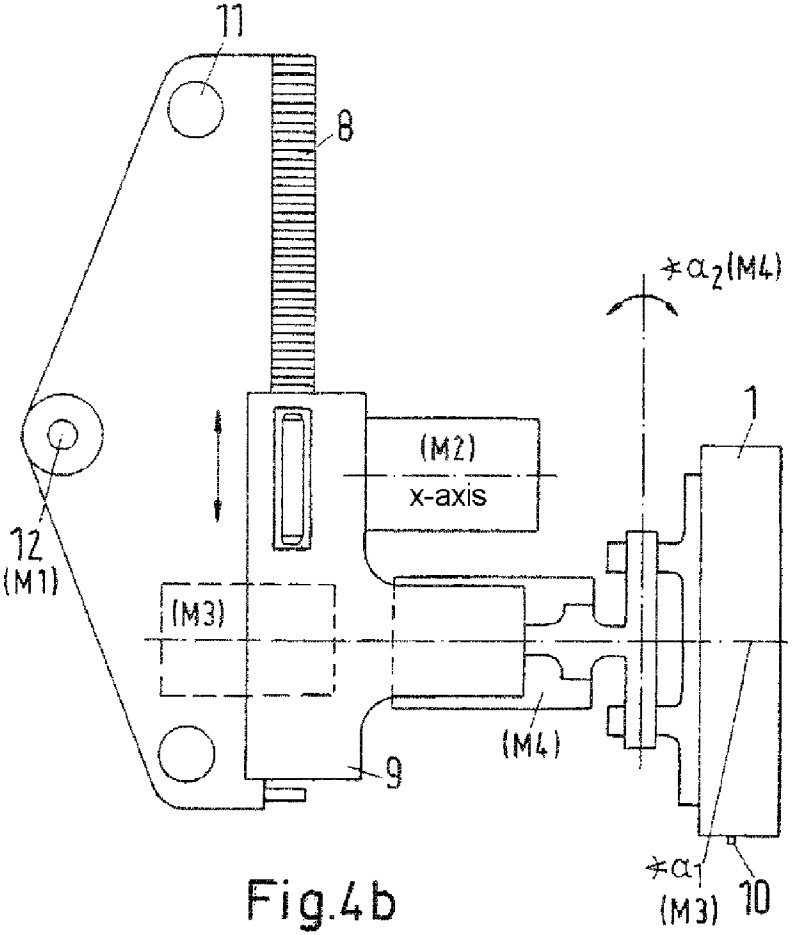
FIG. 4*b* is a top view of the device shown in FIG. 4*a*, FIGS. 5*a* and 5*b* show examples of possible markings on a container for determining the position of the print head.
Figure 4A:
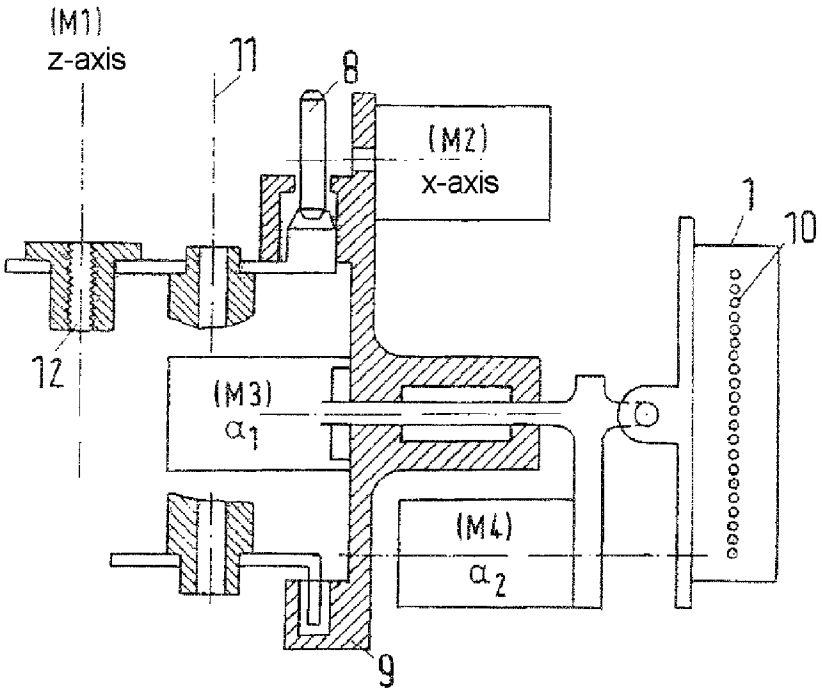
FIG. 4*a* is a sectional view of details of a device for adjusting the print head in different axes.

FIGS. 4*a* and 4*b* show a sectional view and a top view respectively of a device for the fine adjustment of both the position and the orientation of the print head 1 in the different axes. FIG. 4*a* does not show the guide of the set-axis and the spindle drive for the height adjustment. FIG. 4*b* shows the same arrangement in top view.

Figure 5A:
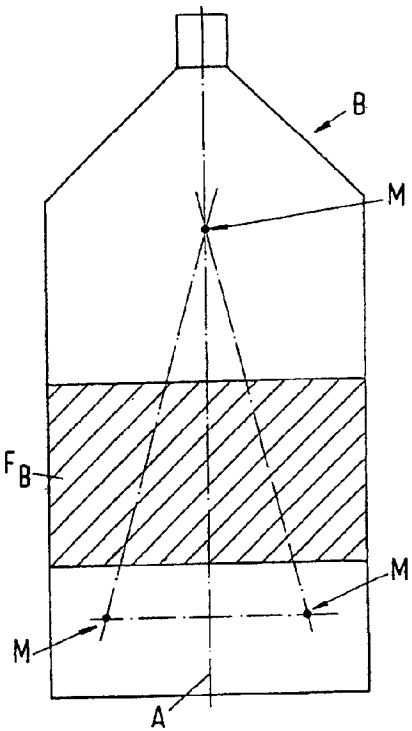

FIG. 5*a* shows an isosceles triangle for use as a marking M for the positioning of the print head 1 by local coordinates and/or angular position. The points inside the triangle can be located outside or inside the print image surface $F_B$. These points serve, among other things, for the calculation of the inclination of the container B. These points also serve to calculate the height of the print image surface F above the turntable 2. When two such triangles have been applied to the container B offset by 90°, the two angles that define the inclination, namely the angles α1 and α2 as shown in FIGS. 1*d*, 4*a*, 4*b*, are uniquely definable.

Figure 5B:
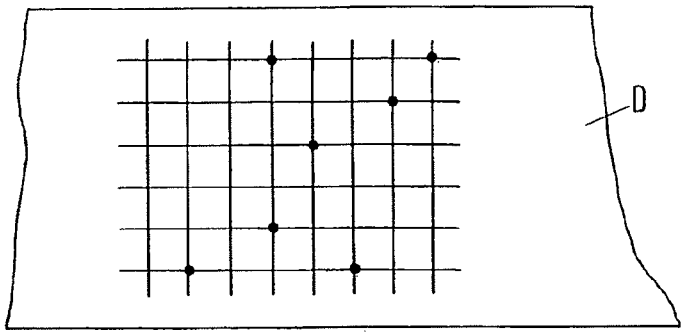

FIG. 5*b* illustrates an example in which individual dots of the print image D itself are used as markings in order to define or calculate the position and orientation of the print head 1 relative to the container B and to output a corresponding adjusting signal for adjusting the print head 1.

Figure 6A:
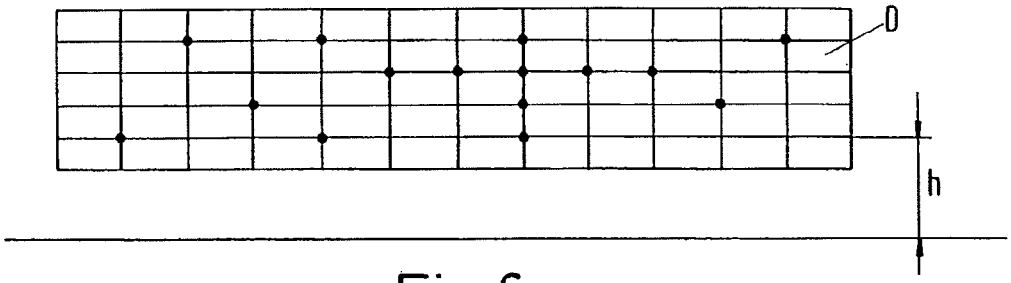
FIGS. 6*a* and 6*b* show a comparison of the development of a print image of a first printing machine on a container in a perpendicular axis position and on a second printing machine with an inclined position randomly resulting there during clamping.
Figure 6B:
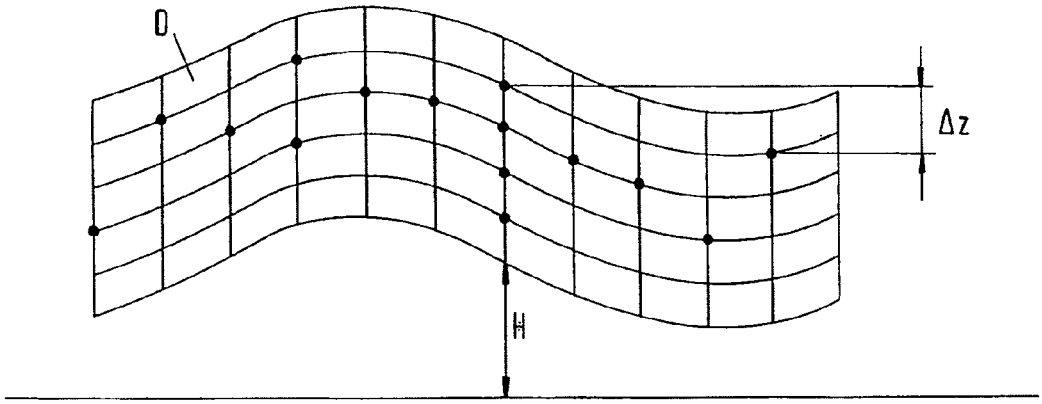

In some cases, containers B to be printed upon, such as bottles, can have a non-circular transverse cross-section, such as an oval cross-section. In other cases, the container may have been placed on the turntable 2 in such a way that the axis of the turntable 2 and the axis of the container B do not line up. As a result, the container B does not rotate about the own axis. Instead, the container B rotates about the axis of the turntable 2. In such cases, it is possible to change the distance between print head 1 and the surface to be printed upon while the container is rotating, since the print image D shown in FIG. 6*a* on a subsequent printing station presents itself as copy of the image in FIG. 6*b*. Thus, by observing the distortion of FIG. 6*b* relative to FIG. 6*a*, it is possible to infer the position and orientation of the container's surface and to perform fine adjustment of the print head 1 accordingly.

To achieve the foregoing, the sensors continuously measure the distance between the print head 1 and container surface and provide information required to readjust the position and orientation of the print head 1 relative to the container, namely a distance value along the x-axis and the angles α1 and α2, and to do so even while the container is actively rotating. By doing so, the position and orientation of the print head 1 relative to the surface to be printed upon remains constant even when, for example, oval bottles are to be printed.

Having described the invention, and a preferred embodiment thereof, what is claimed as new and secured by Letters Patent is:

1. An apparatus for printing a design on a container, said apparatus comprising a first rotary printing machine, a second rotary printing machine that follows said first rotary printing machine, and a controller that operably interlinks said first rotary printing machine and said second rotary printing machine, wherein each of said first and second rotary printing machines comprises a plurality of printing stations, wherein each printing station from said plurality of printing stations comprises a print head that has an adjustable position and orientation relative to a container, and a measuring device configured to determine said position and orientation of said print head relative to said container, wherein said measuring device comprises sensors that are arranged such that a distance between said print head and said container is continuously measurable, wherein said measuring device is configured to receive, from said sensors, information representative of said position and orientation of said print head relative to said container and to provide said information to said controller, and wherein said position and orientation of said print head relative to said container is adjustable by said controller based at least in part on said information provided by said measuring device.

2. The apparatus of claim 1, wherein said first rotary printing machine is configured to print a marker on said container, and wherein said second rotary printing machine is configured to use said marker as a basis for at least one of positioning and aligning a print head of said second rotary printing machine.

3. The apparatus of claim 2, wherein said printing station is configured to rotate said container during revolution of said carousel by at least one complete rotation while said container is being printed upon.

4. The apparatus of claim 2, wherein said marker includes an irregular polygon.

5. The apparatus of claim 2, wherein said marker includes an isosceles triangle.

6. The apparatus of claim 2, wherein said marker is part of said print design.

7. The apparatus of claim 1, further comprising an infeed starwheel, a carousel, a linear conveying device, a clamping device, and a printing station, wherein said printing station is disposed on said carousel, wherein said infeed starwheel is configured to receive a container from said linear conveying device and to introduce said container into said printing station of said carousel, and wherein said clamping device is configured to center said received container and to place said container into rotation.

8. The apparatus of claim 7, further comprising an outfeed starwheel, and a UV tunnel, wherein said outfeed starwheel is disposed to transport a container to said UV tunnel, and wherein said UV tunnel is configured to cure ink that has been applied to said container.

9. The apparatus of claim 8, wherein said UV tunnel is disposed between said first and second rotary printing machines such that a container that has been printed on by said first rotary printing machine passes through said UV tunnel on its way to said second rotary printing machine, whereby ink placed on said container by said first rotary printing machine is cured when said container arrives at said second rotary printing machine.

10. The apparatus of claim 7, wherein said first rotary printing machine is configured to print a marker on said container, and wherein said second rotary printing machine comprises a camera for capturing an image of said marker and emitting an alignment signal for positioning said printing head of said second rotary printing machine.

11. The apparatus of claim 1, wherein said first and second rotary printing machines comprise rotational treatment machines.

12. The apparatus of claim 1, wherein said first and second rotary printing machines comprise carousels.

13. The apparatus of claim 1, wherein said control device comprises an electrical control device.

14. The apparatus of claim 1, wherein said second printing machine is configured to print using an ink that differs in color from an ink used by said first printing machine.

15. The apparatus of claim 1, wherein said first and second printing machines operate individually and independently of each other.

16. The apparatus of claim 1, wherein said first and second printing machines are interlinked in control.

* * * * *